US009132568B2

(12) United States Patent
Peterson

(10) Patent No.: US 9,132,568 B2
(45) Date of Patent: Sep. 15, 2015

(54) CHAINSAW WITH CUTTING CHAIN TENSIONER

(75) Inventor: Brent Peterson, Buffalo Grove, IL (US)

(73) Assignee: Echo, Inc., Lake Zurich, IL (US)

( * ) Notice: Subject to any disclaimer, the term of this patent is extended or adjusted under 35 U.S.C. 154(b) by 82 days.

(21) Appl. No.: 13/270,670

(22) Filed: Oct. 11, 2011

(65) Prior Publication Data

US 2013/0086810 A1 Apr. 11, 2013

(51) Int. Cl.
*B27B 17/04* (2006.01)
*B27B 17/14* (2006.01)

(52) U.S. Cl.
CPC ..... *B27B 17/14* (2013.01); *Y10T 83/7239* (2015.04)

(58) Field of Classification Search
CPC ..... B27B 17/02; B27B 17/14
USPC ..... 30/381–387; 83/816, 818; 411/917, 411/964; 116/DIG. 34, 315, 316, DIG. 17; 74/527, 553
See application file for complete search history.

(56) References Cited

U.S. PATENT DOCUMENTS

| | | | | | |
|---|---|---|---|---|---|
| 2,430,606 | A | * | 11/1947 | Franz | 411/143 |
| 2,632,242 | A | * | 3/1953 | Musso | 30/41 |
| 3,570,325 | A | * | 3/1971 | Kroll et al. | 74/527 |
| 5,054,199 | A | * | 10/1991 | Ogawa et al. | 30/34.1 |
| 5,134,898 | A | * | 8/1992 | Anderson | 74/527 |
| 5,491,899 | A | | 2/1996 | Schliemann et al. | |
| 5,522,143 | A | * | 6/1996 | Schliemann et al. | 30/386 |
| 5,862,715 | A | * | 1/1999 | Lemire | 74/553 |
| 6,237,228 | B1 | | 5/2001 | Moody | |
| 6,237,229 | B1 | | 5/2001 | Igawa et al. | |
| 6,493,949 | B2 | | 12/2002 | Kondo et al. | |
| 6,532,671 | B1 | * | 3/2003 | Jong | 30/386 |
| 6,560,879 | B2 | | 5/2003 | Franke et al. | |
| 6,564,459 | B1 | | 5/2003 | Steinbrueck et al. | |
| 6,637,117 | B2 | | 10/2003 | Kobayashi | |
| 6,694,623 | B1 | | 2/2004 | Haughey | |
| 6,763,966 | B2 | * | 7/2004 | Harris | 220/293 |
| 6,782,627 | B2 | | 8/2004 | Hermes et al. | |
| 6,877,233 | B1 | | 4/2005 | Franke | |
| 6,884,011 | B1 | * | 4/2005 | Saward | 410/106 |
| 7,107,689 | B2 | | 9/2006 | Keeton | |
| 7,155,832 | B2 | | 1/2007 | Warfel | |
| 7,287,330 | B1 | | 10/2007 | Riha | |
| 7,322,114 | B2 | | 1/2008 | Kawamura | |

(Continued)

FOREIGN PATENT DOCUMENTS

| | | | | |
|---|---|---|---|---|
| GB | 2355226 | * | 4/2001 | B27B 17/14 |
| JP | 2003-251602 | * | 9/2003 | B27B 17/14 |

*Primary Examiner* — Laura M Lee
(74) *Attorney, Agent, or Firm* — Wood, Phillips, Katz, Clark & Mortimer

(57) ABSTRACT

A saw having a power unit with a drive component and a housing for the power unit with a frame. A bar on the housing guides movement of an operatively positioned cutting chain driven by the drive component in an endless path. The bar is movable guidingly in opposite directions in a predetermined path relative to the housing to thereby vary tension upon an operatively positioned cutting chain. A bar fixing assembly has a knob that is turnable around a first axis relative to the housing in: a) a first direction to a tightened state; and b) a second direction to a loosened state. A first assembly resiliently bears against the knob to at least one of: a) inhibit turning of the knob around the first axis; b) provide a sensory indication to a user grasping and turning the knob that the knob is moving around the first axis; and c) reduce play in the knob.

30 Claims, 10 Drawing Sheets

(56) References Cited

U.S. PATENT DOCUMENTS

| | | | | |
|---|---|---|---|---|
| 7,350,301 | B2 | 4/2008 | Chung Lee | |
| 7,434,502 | B2 | 10/2008 | Keeton et al. | |
| 7,600,323 | B2 | 10/2009 | Sugishita | |
| 7,676,934 | B2 | 3/2010 | Liao | |
| 7,743,513 | B1 | 6/2010 | Fisher et al. | |
| 2002/0124421 | A1* | 9/2002 | Hermes et al. | 30/386 |
| 2006/0207111 | A1* | 9/2006 | Sugishita | 30/386 |
| 2008/0178468 | A1* | 7/2008 | Liao | 30/34.05 |
| 2009/0007439 | A1 | 1/2009 | Sugishita | |
| 2009/0077814 | A1* | 3/2009 | Gibbons et al. | 30/376 |
| 2009/0241353 | A1 | 10/2009 | Ericson et al. | |
| 2010/0088905 | A1 | 4/2010 | Pellenc | |
| 2010/0146801 | A1 | 6/2010 | Pellenc | |
| 2011/0308096 | A1* | 12/2011 | Yu et al. | 30/386 |

* cited by examiner 102
36
22
128
124
104
120
62
114
112
60
118
106
108
110
116
110
116
106
60

CHAINSAW WITH CUTTING CHAIN TENSIONER

BACKGROUND OF THE INVENTION

1. Field of the Invention

This invention relates to chainsaws and, more particularly, to a chainsaw with a mechanism for selectively tensioning an endless cutting chain thereon.

2. Background Art

Chainsaws are commonly configured with a main housing that contains a power unit. The housing has operating handles thereon that allow a user to conveniently lift and reposition the chainsaw. A trigger is provided on one of the handles through which operating speeds for the chainsaw are controlled.

The housing includes a frame to which a chain bar is operatively connected. The chain bar has a track for guiding movement of a chain in an endless path. With the chain bar operatively positioned, the chain can be trained around both the bar and a toothed component that is driven by the power unit.

Virtually every chain bar is connected to its supporting frame so as to be translatable guidingly in a line generally parallel to the bar length. By selectively shifting the chain bar lengthwise relative to the frame in opposite directions, the endless path for the chain, defined cooperatively by the chain bar and toothed drive component, can be effectively lengthened and shortened. Shortening of this path allows the chain to be initially installed in a slackened state upon the bar. Thereafter, the bar is shifted an amount to produce a desired tension upon the chain, whereupon the chain is fixed, as by tightening one or more threaded components that positively bear the chain bar against the housing frame.

As the chainsaw is operated, there is a tendency of the chain bar to shift in a manner whereby the chain may become slackened. This condition may be the result of pressures applied to the chain bar during cutting operations that cause the chain bar to shift. Additionally, the chain has a link construction that is prone to becoming lengthened over extensive use periods.

To compensate for this condition, chainsaws are commonly made with mechanisms that facilitate loosening of the chain and re-tensioning after the initial installation thereof. Early versions of these tensioners were quite basic and required tools to loosen fasteners and retighten the same after the chain tension was reset.

Tool-operated tensioners, while functionally effective, have drawbacks. First of all, the user is required to keep on hand and available the required tool or tools demanded by a particular design to operate the tensioner. If the necessary tools are for some reason not available, potentially the chainsaw will be inoperable. Alternatively, a user risks that a slackened chain might become damaged or, in a worst case, separate from the bar as the chainsaw is being operated.

Further, even if the user has on hand the necessary tool(s), manipulation of a separate tool is inherently inconvenient. This is aggravated by the fact that heavy gloves are recommended when using chainsaws. Thus, the operator is normally required to remove his/her gloves preparatory to changing the tension on the chain. This is particularly inconvenient in cold weather conditions and/or when there is precipitation.

The inconveniences associated with handling separate tools prompted the industry to develop tensioners that are characterized as "toolless". Toolless tensioning involves hand manipulation of components that at all times remain part of the chainsaw unit.

Those designing toolless tensioners are guided by a number of different criteria. First of all, the structure must be reliable and convenient to operate. A failure of a component of a toolless system may render the entire chainsaw unusable until a repair is effected. Further, the steps required to re-tension a chain must be such that they are less onerous than those to re-tension chains using separate tools.

It is also preferred that the tensioning system be relatively simple in terms of its design. Complicated mechanisms often become expensive by reason of the high cost of the parts themselves, as well as their assembly. Complicated designs inherently tend to be more prone to failure than those that are more simplified.

There are currently many different toolless tensioner designs available, including many which are patented and many in commercial form.

Common to many of these designs is the incorporation of a hand-graspable knob that can be turned to selectively release and fix the chain bar in a desired position. Various mechanisms have been developed to maintain the knob in a desired, tightened position. This has been accomplished through separate latching components, use of ratchet mechanisms, use of parts with engaging teeth, etc.

While the above types of mechanisms have been effective in terms of holding the operating knob in a desired position and preventing rattling thereof, they do have drawbacks. Use of separate latching components, aside from generally requiring a relatively complicated design, requires a user to releasably set the latch each time the chain is re-tensioned. This introduces a level of inconvenience to the operator.

Further, the cooperating structures on relatively movable components, that prevent loosening and rattle, generally require parts to act against each other in a manner whereby they are prone to wear, particularly after extended use of the chainsaw.

The industry continues to develop new designs for toolless tensioners. These new designs are motivated by a desire to offer an affordable toolless tensioning option that is reliable and convenient to operate. The design process is complicated by the fact that these objectives are often competing in nature.

SUMMARY OF THE INVENTION

In one form, the invention is directed to a saw having a power unit with a drive component and a housing for the power unit with a frame. A bar on the housing guides movement of an operatively positioned cutting chain, driven by the drive component, in an endless path. The bar is movable guidingly in opposite directions in a predetermined path relative to the housing to thereby vary tension upon an operatively positioned cutting chain. A bar fixing assembly has a knob that is turnable around a first axis relative to the housing in: a) a first direction to a tightened state wherein the bar is fixed relative to the housing; and b) a second direction, with the knob in the tightened state, to a loosened state wherein the bar can be moved relative to the housing in the predetermined path. A first assembly resiliently bears against the knob to at least one of: a) inhibit turning of the knob around the first axis; b) provide a sensory indication to a user grasping and turning the knob that the knob is moving around the first axis; and c) reduce play in the knob.

In one form, the drive component is a toothed sprocket that can be placed in mesh with an operatively positioned cutting chain. An operatively positioned cutting chain is trained around the bar and the toothed sprocket.

In one form, the saw further includes a tensioning assembly with an actuator that can be repositioned by a user's hand with the knob in the loosened state, without the need for separate tools, to thereby move the bar in the predetermined path.

In one form, the saw is provided in combination with a cutting chain that is operatively positioned.

In one form, the first assembly has a first component that is biased in a direction generally parallel to the first axis against a first surface relative to which the first component moves as the knob is turned around the first axis.

In one form, the first component traces an annular path around the first axis on the first surface as the knob is turned around the first axis. The first surface over the annular path is contoured so that the first component is caused by the first surface to shift oppositely substantially parallel to the first axis as the knob is turned around the first axis.

In one form, the first surface has a plurality of depressions spaced around the first axis and the first component moves into and out of the depressions as the knob is turned around the first axis.

In one form, the first component has a convex surface that moves into and out of the depressions and the depressions have a shape that is complementary to the convex surface of the first component.

In one form, the first component has a spherical shape and the depressions are bounded by surfaces defining a segment of a sphere.

In one form, the first surface is defined on the knob.

In one form, the first component is biased by a coil spring to against the first surface.

In one form, the saw further has a guard plate on one side of the bar and a mounting plate between the knob and the guard plate. The first component is attached to the mounting plate.

In one form, the knob has a main body and a lever that is movable relative to the body between an operative position and a stowed position. The lever in the operative position is engageable by a user and repositionable to facilitate turning of the knob body around the first axis.

In one form, the main body has a radial outer surface. With the knob lever in the operative position, the knob lever projects radially from the first axis beyond the radial outer surface of the main body.

In one form, with the lever in the stowed position, the main body is movable around the first axis relative to the housing.

In one form, the housing has an annular surface that fully surrounds the main body.

In one form, the first component and first surface interact to generate an audible repetitive clicking sound as the knob is turned around the first axis.

In one form, the first component and first surface interact to produce a repetitive force upon the knob that can be tactilely sensed by a user grasping and turning the knob around the first axis.

In one form, the first component and first surface interact to generate forces that resist turning of the knob around the first axis as the first component moves repetitively and serially into and out of the depressions.

In one form, the depressions are at closely spaced regular intervals around the first axis so that there is a thin step between adjacent depressions around the first axis.

DETAILED DESCRIPTION OF THE PREFERRED EMBODIMENT

Figure 1:
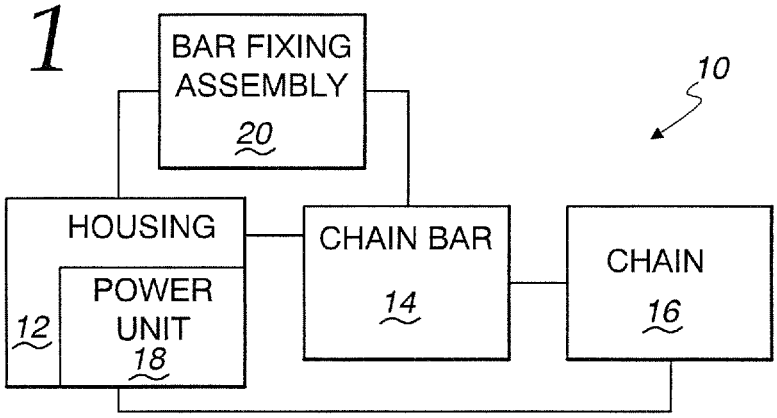
FIG. 1 is a schematic representation of a saw suitable for incorporation of the present invention.
Figure 2:
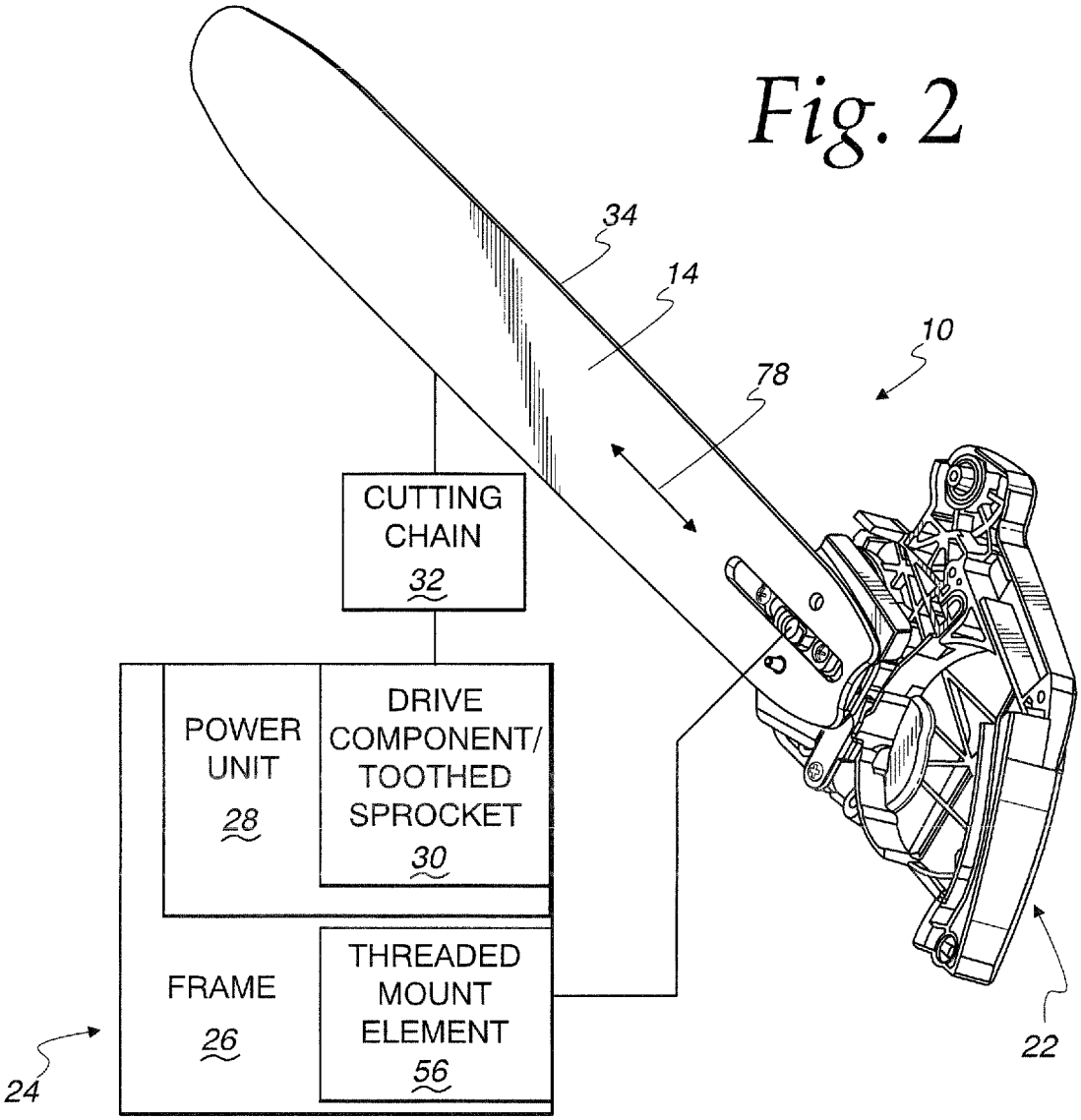
FIG. 2 is a partially schematic, perspective view of one specific form of saw as in FIG. 1 with structure, according to the present invention, for fixing a cutting chain bar and incorporating on one housing part a knob through which the chain bar can be selectively fixed and loosened for adjustment.
Figure 3:
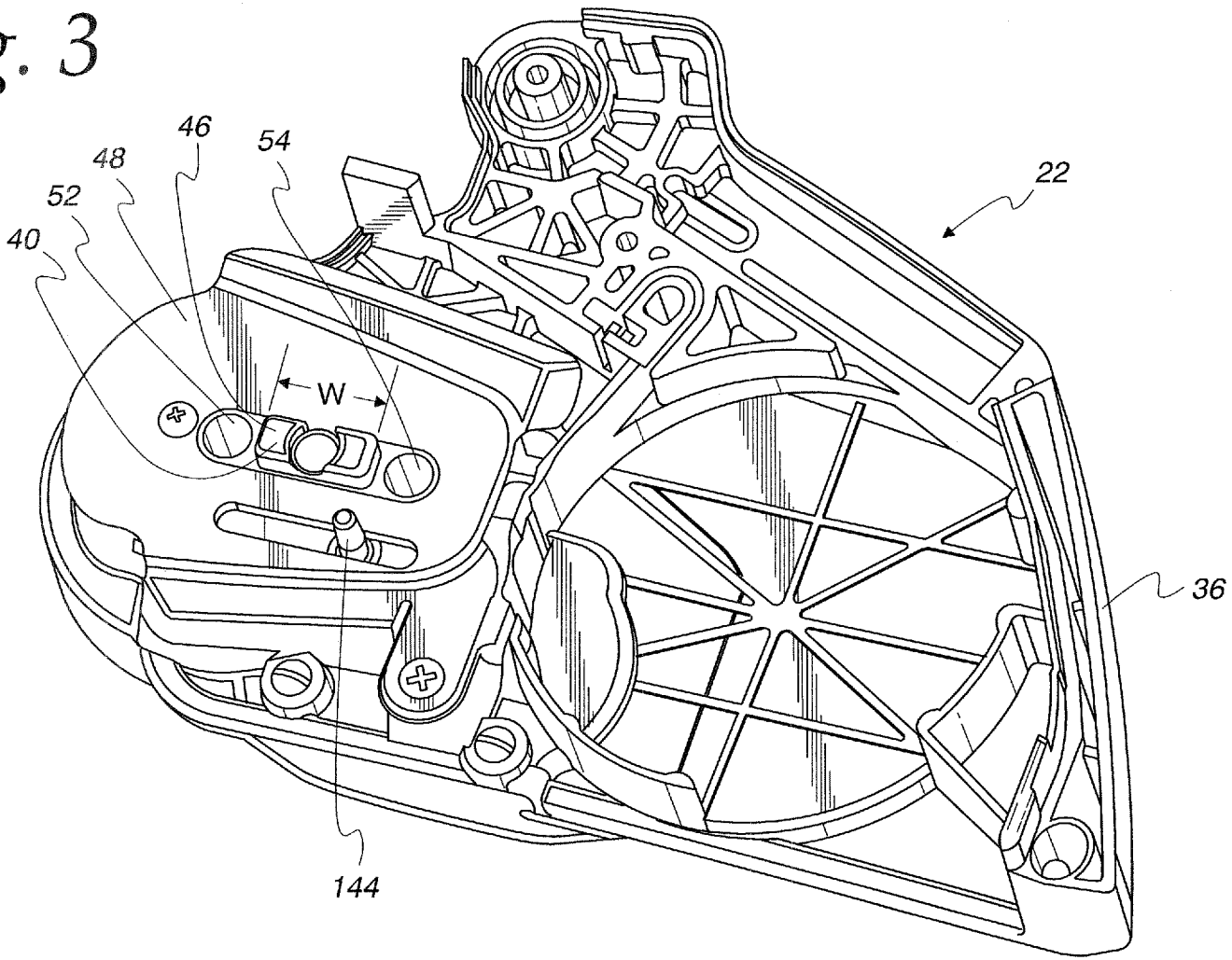
FIG. 3 is an enlarged, perspective view of the housing part in FIG. 2 with the chain bar removed.
Figure 4:
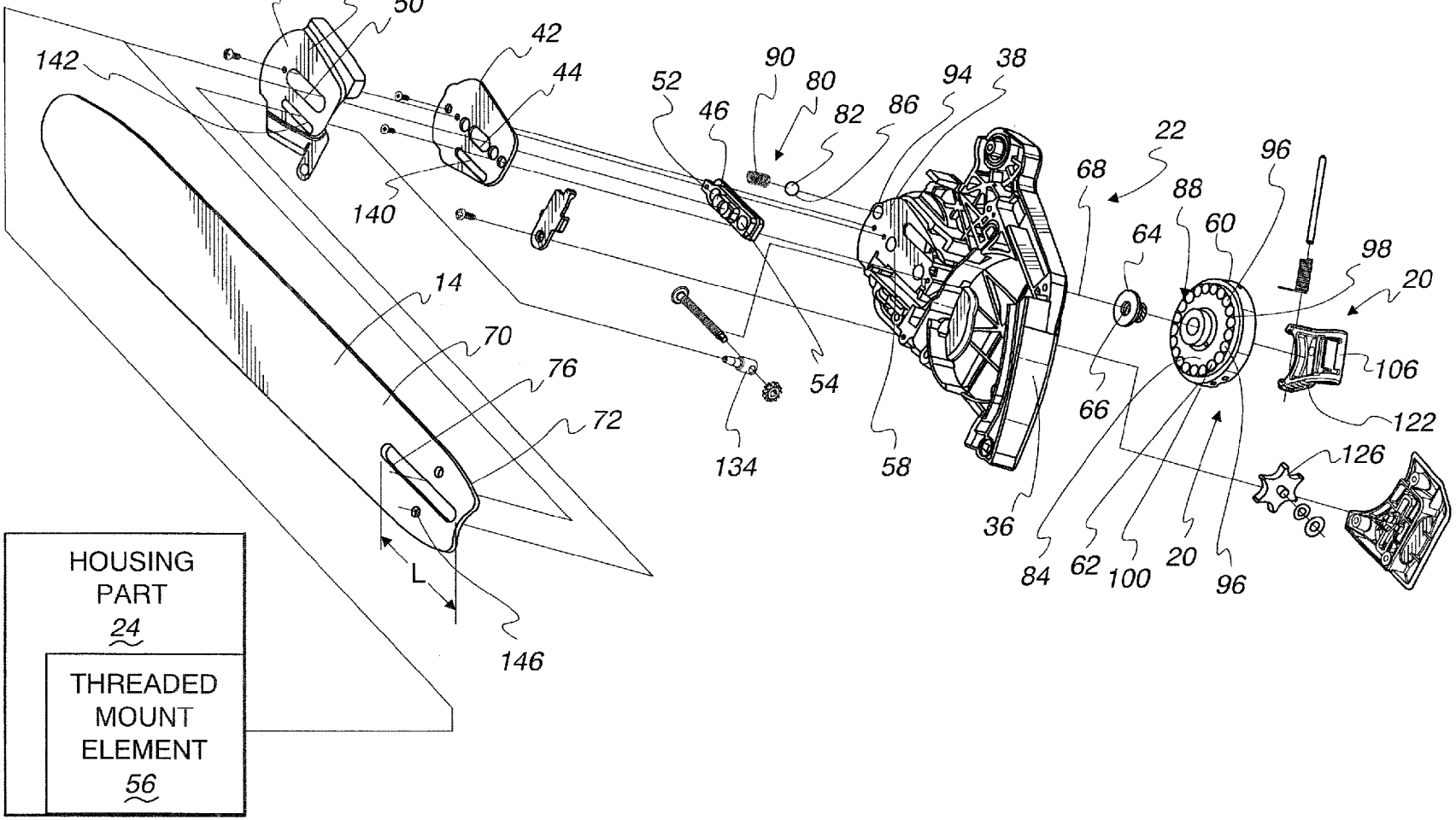
FIG. 4 is an exploded, perspective view of the saw in FIGS. 1-3.
Figure 5:
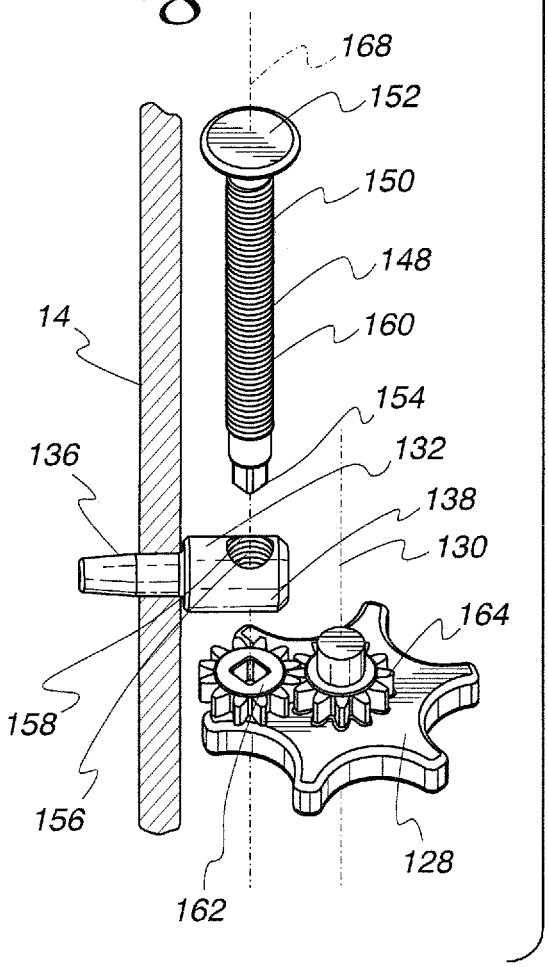
FIG. 5 is an enlarged, exploded, fragmentary, perspective view of a tensioning assembly for a cutting chain on the saw in FIGS. 1-4.
Figure 6:
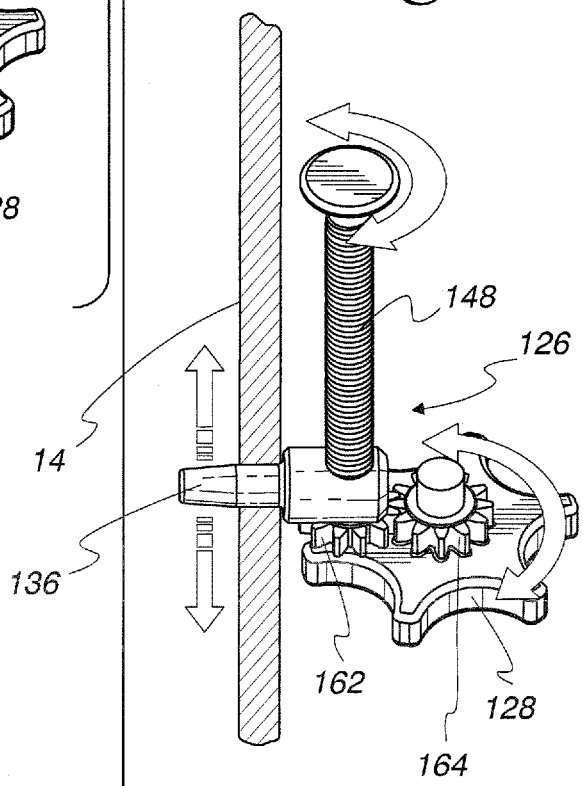
FIG. 6 is a view as in FIG. 5 with the components in assembled relationship.
Figure 7:
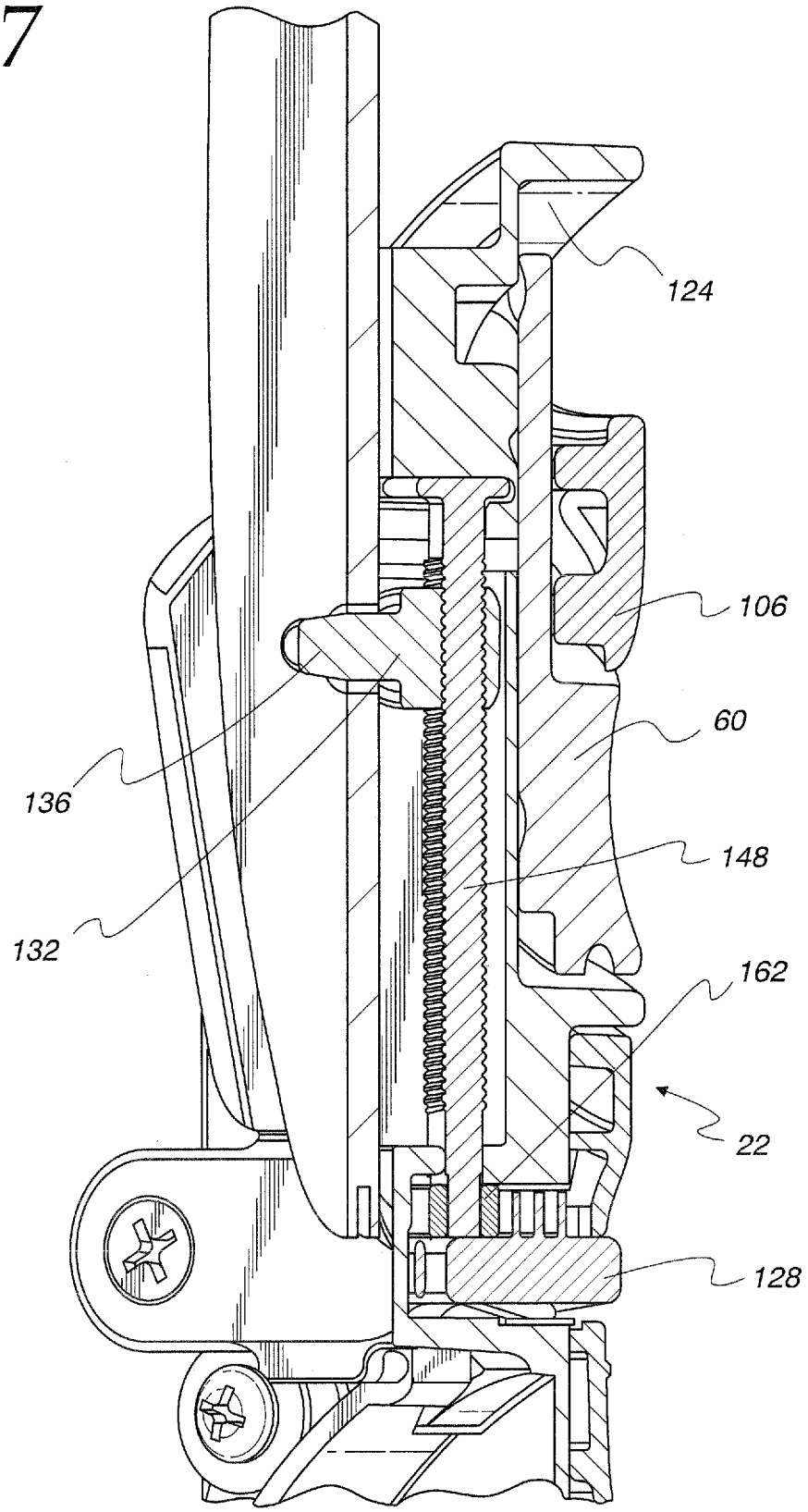
FIG. 7 is an enlarged, fragmentary, partial cross-sectional view of a portion of the saw in FIGS. 1-4 and showing the tensioning assembly in FIGS. 5 and 6.
Figure 8:
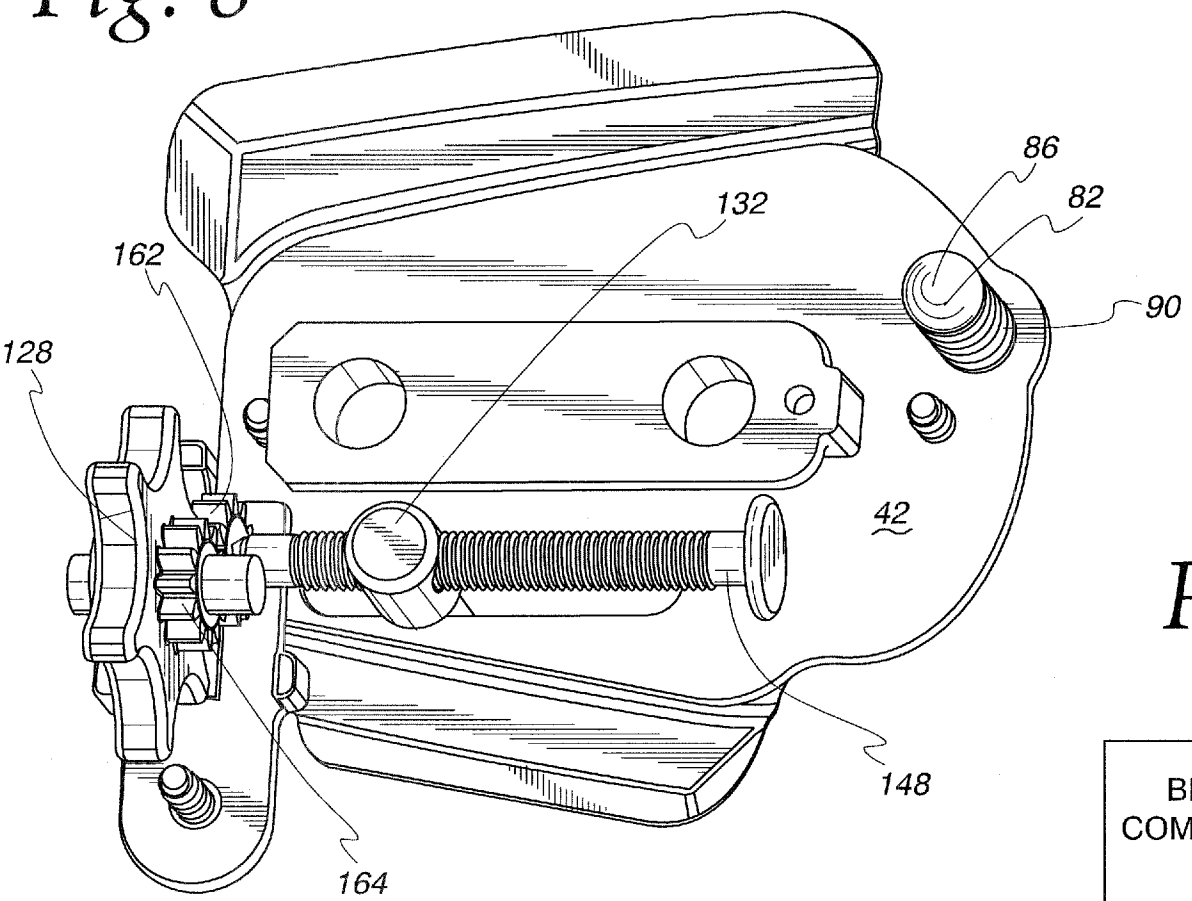
FIG. 8 is an enlarged, perspective view of the tensioning assembly in FIGS. 5-7 in relationship to associated mounting plates.

In FIG. 1, a saw of the type suitable for incorporation of the present invention is shown at 10. The saw 10 is shown in schematic form to encompass specific component forms, as described hereinafter, and variations thereof. The saw 10 has a housing 12 to which a chain bar 14 is attached. The chain bar 14 is movable guidingly relative to the housing 12 to thereby vary tension upon a cutting chain 16 that is trained around the chain bar 14 and a component on a power unit 18 through which the saw 10 is operated. The chain bar 14 is fixed in different positions by a bar fixing assembly 20. The invention herein is focused primarily upon the bar fixing assembly 20 and associated structure. The other components may take a wide variety of different forms and are of the type generally known to those skilled in the art. Exemplary saw structures are described in detail in U.S. Pat. Nos. 6,237,229 and 7,322,114, incorporated herein by reference. These well-known components will not be described in detail hereinbelow, as the specific structure and function thereof is not critical to the operation of the present invention.

Referring now to FIGS. 2-15, an exemplary form of the saw 10 is shown with joinable housing parts 22, 24. The housing parts 22, 24 cooperatively make up a housing that includes a frame 26 upon which components can be operatively mounted. Among these components is a power unit 28 that is commonly operated either electrically or through an engine that combusts a fuel. The power unit 28 is operable to turn a drive component/toothed sprocket 30.

A cutting chain 32 has an endless construction formed from joined links. The cutting chain 32 is trained around both the chain bar 14 and drive component/toothed sprocket 30. The chain bar 14 has a peripheral track 34 within which the cutting chain 32 moves. The drive component/toothed sprocket 30 drives the inside of the cutting chain 32 through teeth thereon that are in meshed relationship with the chain 32.

The chain bar 14 is captively maintained in an operative position between the housing parts 22, 24. The housing part 22 consists of a base component 36 with a flat mounting wall 38 against which a guide block 40 is mounted. The guide block 40 is maintained captively against the wall 38 by a mounting plate 42 that has an opening 44 to receive a complementarily-shaped, rectangular projection 46 on the guide block 40. A guard plate 48 overlies the mounting plate 42 and has an opening 50 to accept the projection 46 and is large enough to keep openings 52, 54 on the guide block 40 exposed.

With the housing parts 22, 24 joined, a threaded mount element 56 on the housing part 24 projects through the openings 50, 44, 52, that are aligned with each other, and an opening 58 through the mounting wall 38 to be exposed to be engaged by a knob 60 on the bar fixing assembly 20. The knob 60 has a body 62 with an insert 64 having internal threads 66 to engage the threads on the mount element 56. Turning of the knob 60 about an axis 68 in a first direction places the knob 60 in a tightened state wherein the chain bar 14 is captively fixed between the housing parts 22, 24. With the knob 60 initially in the tightened state, turning of the same in a second direction, opposite to the first direction, places the knob 60 in a loosened state wherein the chain bar 14 can be moved relative to the housing 12 in a controlled, predetermined manner as described hereinbelow. The knob 60 moves in a turning range as it changes between the tightened and loosened states.

The chain bar 14 has a generally flat body 70 with one flat side 72 placed facially against a flat surface 74 on the guard plate 48. In this position, the projection 46 on the guide block 40 extends into an elongate guide slot 76 on the chain bar 14. The guide slot 76 has a length L that is greater than a greater corresponding length L1 of the projection 46. With this configuration, the chain bar 14 can be guidingly slid, in a fore-and-aft direction, as indicated by the double-headed arrow 78, thereby to vary tension upon the operatively positioned cutting chain 16.

A first assembly at 80 is provided with a part to resiliently bear against a part of the knob 60 to at least one of: a) inhibit turning of the knob 60 around the axis 68; b) provide a sensory indication to a user grasping and turning the knob 60 that the knob 60 is moving around the axis 68; and c) reduce play in the knob 60. The first assembly 80 permits the knob 60 to turn in opposite directions around the axis 68 through its turning range while the part of the first assembly continues to resiliently bear against the part of the knob 60.

Figure 9:
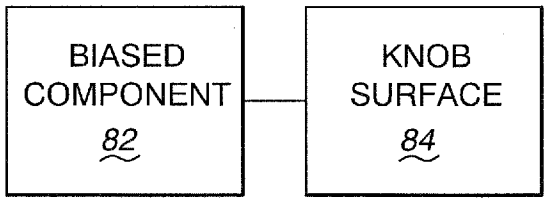
FIG. 9 is a schematic representation of a knob, as shown in FIG. 4, with a biased component, according to the invention, that acts thereagainst.
Figures 10, 11:
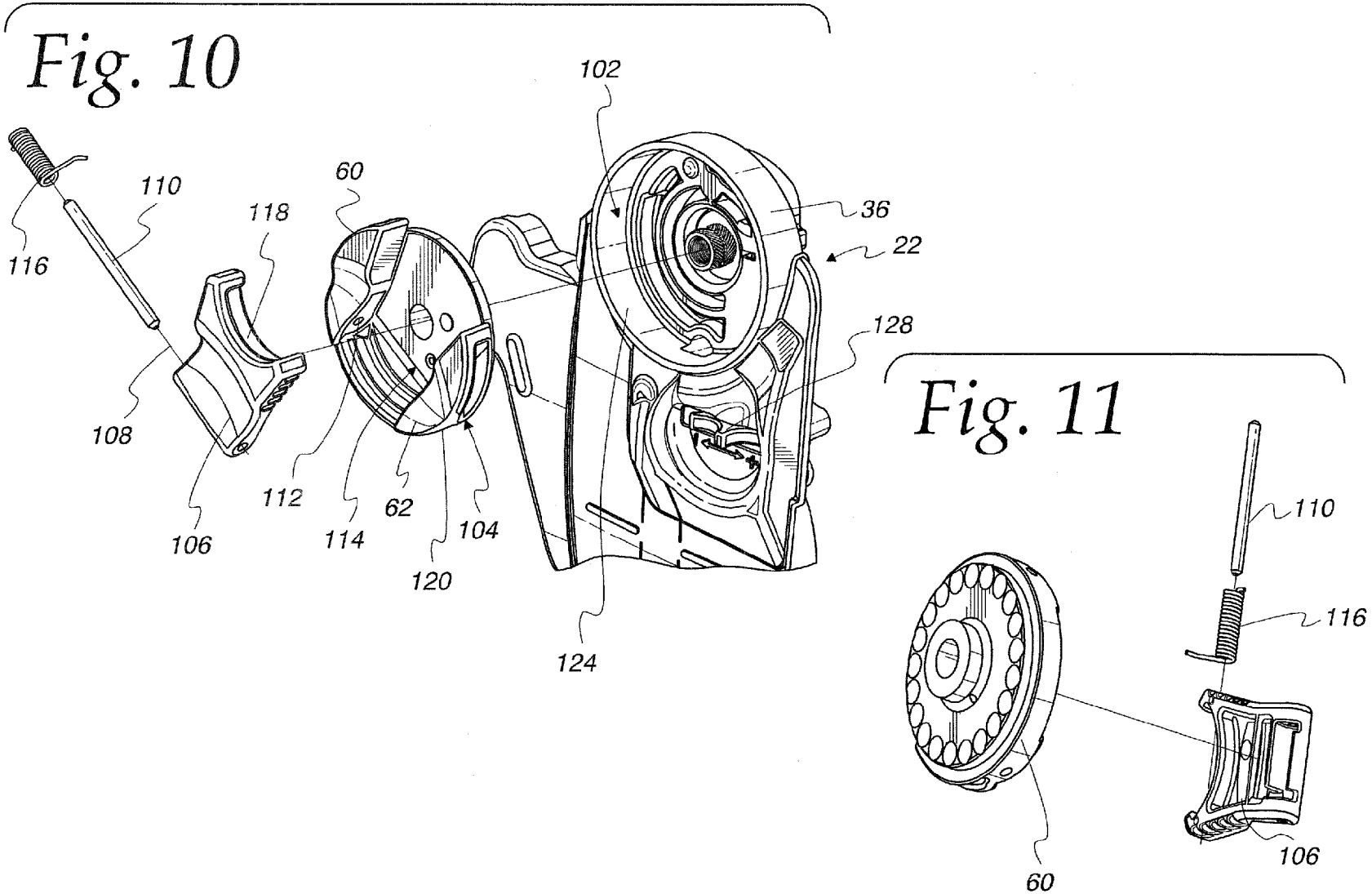
FIG. 10 is an enlarged, exploded, fragmentary, perspective view of a housing part on the saw in FIGS. 1-4 with the knob for selectively fixing and releasing the chain bar.
FIG. 11 is an enlarged, exploded, perspective view of the knob in FIG. 10 from a different angle.

The first assembly 80, as shown in schematic form in FIG. 9, consists of a biased first component 82 that is urged against a knob surface 84. The first assembly 80 is shown in schematic form in FIG. 9 to encompass virtually an unlimited number of different configurations for both the bias component 82 and the knob surface 84 with which it cooperates.

In one exemplary form, as seen particularly in FIGS. 4, 8, 14 and 15, the biased component 82 has a convex outer surface 86 that acts against the knob surface 84. More particularly, the knob surface 84 has a non-flat configuration in an annular path portion, as indicated at 88, that is traced by the component 82 as the knob 60 is turned around the axis 68. The invention contemplates that the non-flat path portion 88 is contoured with any of a number of different shapes that cause the component 82 to move back and forth generally parallel to the axis 68 as the knob 60 is turned.

In a preferred form, the component 82 has a spherical shape and is biased against the knob surface 84 by a coil spring 90. The coil spring 90 is secured to the mounting plate 42 by a threaded fastener 92.

The coil spring 90 projects through an opening 94 in the mounting wall 38 to thereby cause the component 82 to be captively located between the coil spring 90 and the knob surface 84.

In a preferred form, the contoured path portion 88 has a series of depressions 96 at regular intervals around the path portion 88. The depressions 96 are configured to allow the component 82 to move axially thereinto as the component 82 aligns with each depression 96 as the knob 60 is turned. Continued turning of the knob 60 causes the component 82 to move out of a depression 96 and over a thin step 98 that resides between adjacent depressions 96, thereby shifting the component 82 axially away from the knob 60, until it aligns with the next depression 96 into which it is biased.

In a preferred form, the depressions 96 have a shape complementary to that of the spherical surface on the component 82. As an example, the depressions may be bounded by surfaces 100 defining a segment of a sphere.

With this arrangement, the component 82 and contoured knob surface 84 in the path portion 88 interact to generate an audible repetitive clicking sound as the knob 60 is turned around the axis 68. The component 82 and contoured knob surface 84 also interact to produce a repetitive force upon the knob 60 that can be tactilely sensed by a user grasping and turning the knob 60 around the axis 68. At the same time, the cooperating component 82 and contoured knob surface 84 interact to generate forces that resist turning of the knob 60 around the axis 68.

To maintain a narrow profile and streamlined shape, the base component 36 defines a recess 102 that is nominally matched to the perimeter 104 of the knob 60.

To facilitate turning of the knob 60, a lever 106 is attached to the knob body 62 for pivoting movement about an axis 108 defined by a mounting pin 110 that extends through the lever 106 and into spaced sockets 112 on the knob body 62.

Figure 12:
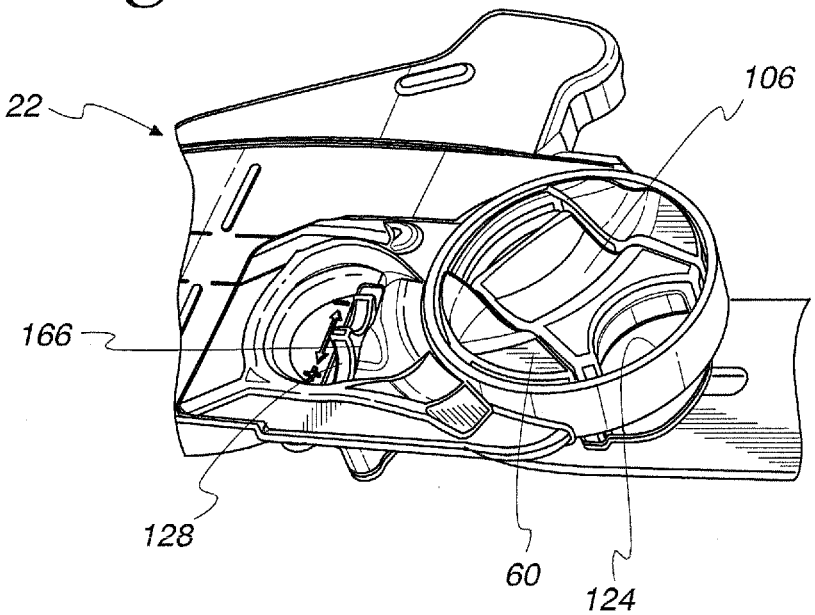
FIG. 12 is a view as in FIG. 10 with the components therein in assembled relationship.

The body 62 defines an axially offset receptacle 114 for the lever 106 with the lever in a stowed position, as shown in FIG. 12. The receptacle 114 is nominally matched to the perimeter shape of the lever 106. A torsion coil spring 116 surrounds the pin 110 and exerts a biasing force on the lever 106, normally urging it towards the stowed position.

Figure 13:
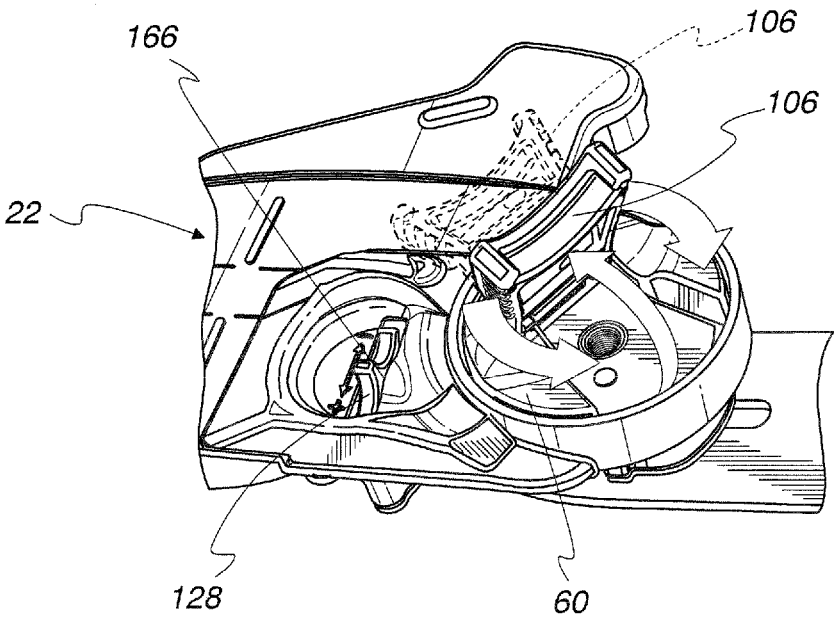
FIG. 13 is a view as in FIG. 12 and showing a lever on the knob transitioned from a stowed position, as shown in FIG. 12 and showing an operative position therefor in dotted lines.
Figure 14:
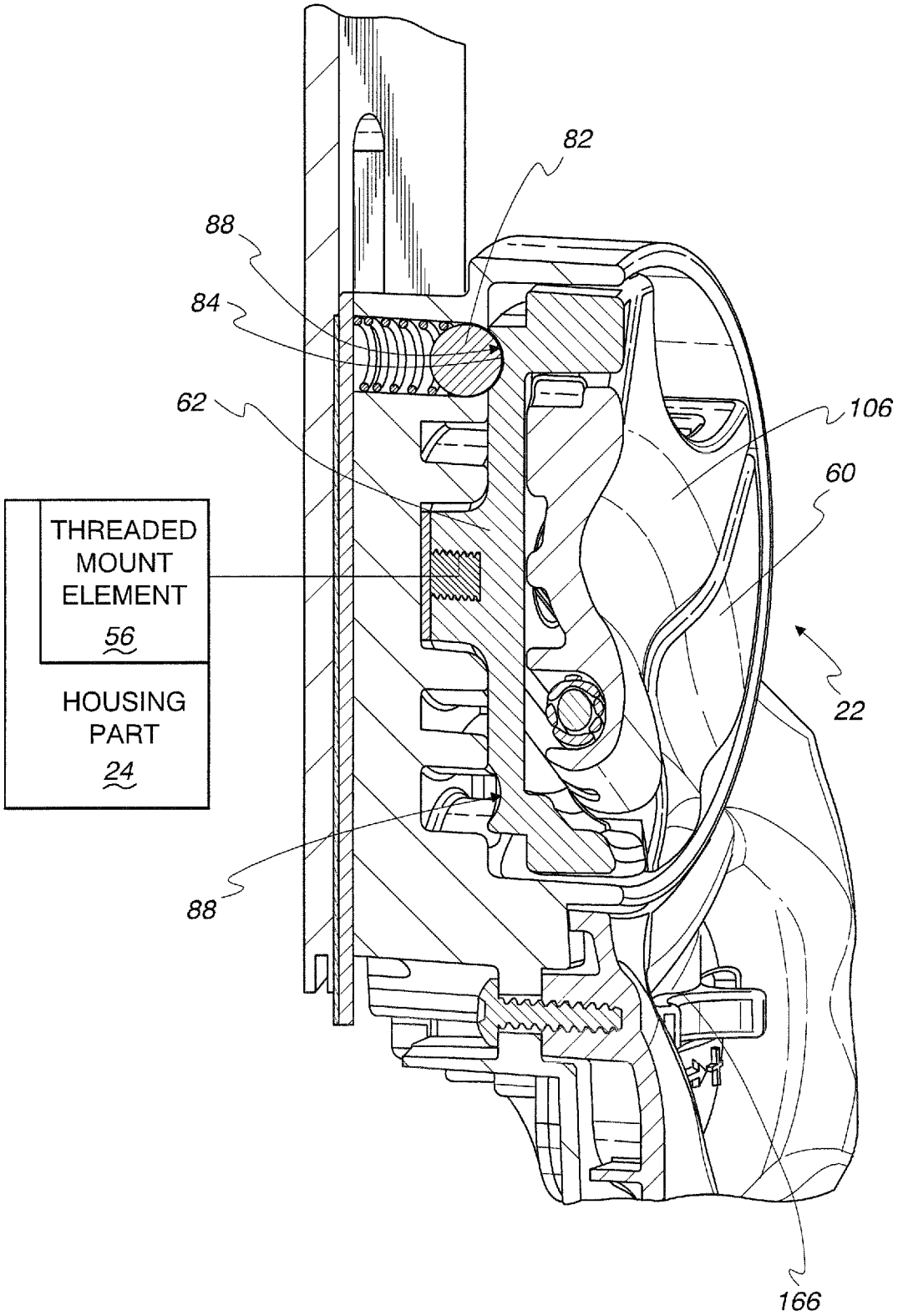
FIG. 14 is an enlarged, fragmentary, partial cross-sectional view of the knob in a stowed position on a cooperating housing part.
Figure 15:
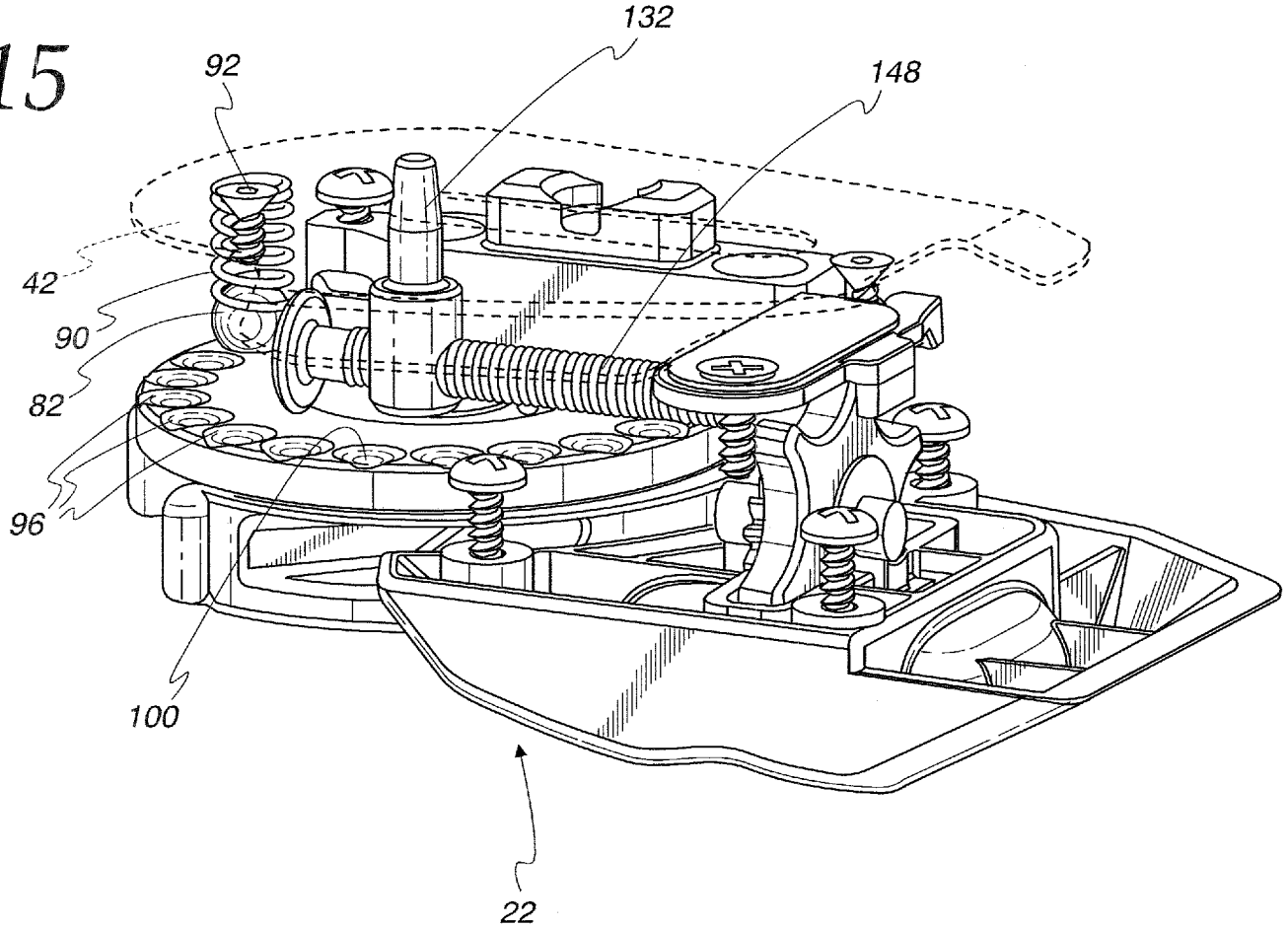
FIG. 15 is an enlarged, fragmentary, perspective view of a portion of the saw in FIGS. 1-4 and showing the knob and chain tensioning assembly.

The lever 106 has a U-shaped gripping edge 118 that can be engaged by a user's fingers to draw the lever 106 out of the stowed position, through a pivoting action, into an operative position, as shown in dotted lines in FIG. 13. In the operative position, the lever 106 projects radially beyond the radially outer surface 120 of the body 62, thereby to create a longer moment arm that facilitates turning of the hand-grasped lever 106 around the axis 68. The lever 106 has a contoured outer surface 122 and a shape that can be conveniently grasped, positively held, and turned by a user's hand, with the lever 106 gripped as between fingers thereon.

An over center spring arrangement can be provided to cause the lever 106 to be urged towards each of the operative and stowed positions therefor. An annular surface 124, bounding the recess 102, fully surrounds the knob 60 and lever 106 with the lever 106 in the stowed position. Among other things, this surface 124 reduces the likelihood of inadvertent contact with the knob 60 and/or lever 106 that may tend to turn the knob 60 around the axis 68. This is a desirable feature since, in one preferred form, the knob 60 is not fixed against turning. The lever 106 may be provided solely for purposes of turning the knob 60 and is not, in a preferred form, configured to lock the knob 60 against turning.

With the knob 60 loosened, the chain bar 14 is movable back and forth in a predetermined path to thereby either increase or decrease tension upon an operatively positioned cutting chain. The invention contemplates that the chain bar 14 might be grasped and shifted by the hand of a user. Alternatively, and more preferably, a tensioning assembly is provided at 126 and facilitates movement of the chain bar 14 back and forth in its predetermined path, preferably without requiring any tools.

The tensioning assembly 126 consists of a star-shaped actuator 128 that is turned around an axis 130 to translate a follower 132. The follower 132 is in the form of a post with a tapered stem 136 and enlarged head 138. The stem 136 projects through aligned slots 140, 142 in the mounting plate 42 and guard plate 48, respectively. An exposed free stem end 144 projects into a bore 146 in the chain bar 14. Through this arrangement, the chain bar 14 will follow translational movement of the post 132 within the slots 140, 142, thereby to move generally parallel to the length of the chain bar 14 back and forth along the line indicated by the double-headed arrow 78.

Turning movement of the actuator 128 about its axis 130 is converted to translatory movement of the post 134 through interaction of an intermediate post 148. The post 148 has a threaded shank 150 with an enlarged head 152 at one end and a polygonal end fitting 154 at its opposite end.

The shank 150 is threadably engaged with the post head 138 by being directed through a bore 156 through the head 138 that has internal threads 158 that are complementary to external threads 160 on the shank 150. With the shank 150 passed through the bore 156, the end fitting 154 is exposed and keyed to a gear 162 that is in mesh with a gear 164 fixed to the actuator 128 to follow turning movement thereof.

The actuator 128 is mounted within a slot 166 to be confined against fore-and-aft shifting relative to the housing part 22. As the actuator 128 is turned about the axis 130, which extends generally in a fore-and-aft direction, through the gear 162, the threaded post 148 is turned, whereby the post 134 shifts along the post axis 168, that extends generally in a fore-and-aft direction and parallel to the axis 130. This causes the post 134 to translate in a fore-and-aft line, thereby causing the chain bar 14 to move in its predetermined path. The direction of movement of the chain bar 14 is determined by the direction of turning of the actuator 128 about its axis 130.

The foregoing disclosure of specific embodiments is intended to be illustrative of the broad concepts comprehended by the invention.

The invention claimed is:

1. A saw comprising:

a power unit with a drive component, a housing for the power unit and comprising a frame;

a bar on the housing for guiding movement of an operatively positioned cutting chain driven by the drive component in an endless path, the bar movable guidingly in opposite directions in a predetermined path relative to the housing to thereby vary tension upon an operatively positioned cutting chain;

a bar fixing assembly comprising a knob that is turnable around a first axis relative to the housing in: a) a first direction to a tightened state wherein the bar is fixed relative to the housing; and b) a second direction with the knob in the tightened state to a loosened state wherein the bar can be moved relative to the housing in the predetermined path, the knob moving in a turning range as the knob changes between the tightened and loosened states; and a first assembly with a first component that resiliently bears against a part of the knob comprising a first surface to thereby produce a force upon the knob that is applied as the knob is turning to thereby give a sensory indication to a user grasping and turning the knob that the knob is moving around the first axis, the first component biased in a first direction generally parallel to the first axis against the first surface relative to which the first component moves as the knob is turned around the first axis, the first surface and component configured so that the first component moves alternatingly in the first direction and oppositely to the first direction as the knob is turning in the same direction about the first axis, the first assembly permitting the knob to turn in opposite directions around the first axis through the turning range with the first component of the first assembly continuing to resiliently bear against the part of the knob, wherein the saw further comprises a mounting plate fixed relative to the housing, wherein the first component is biased away from the mounting plate toward the first surface by a force acting between the mounting plate and the first component.

2. The saw according to claim 1 wherein the drive component is a toothed sprocket that can be placed in mesh with an operatively positioned cutting chain and an operatively positioned cutting chain is trained around the bar and the toothed sprocket.

3. The saw according to claim 1 wherein the saw further comprises a tensioning assembly with an actuator that can be repositioned by a user's hand with the knob in the loosened state without the need for separate tools to thereby move the bar in the predetermined path.

4. The saw according to claim 1 in combination with a cutting chain that is operatively positioned.

5. The saw according to claim 1 wherein the first component traces an annular path around the first axis on the first surface as the knob is turned around the first axis and the first surface over the annular path is contoured so that the first component moves alternatingly in the first direction and opposite to the first direction substantially parallel to the first axis as the knob is turned around the first axis.

6. The saw according to claim 1 wherein the knob has a main body and a lever that is movable relative to the body between an operative position and a stowed position, the lever in the operative position engageable by a user and repositionable to facilitate turning of the knob body around the first axis.

7. The saw according to claim 6 wherein the main body has a radial outer surface and with the knob lever in the operative position the knob lever projects radially from the first axis beyond the radial outer surface of the main body.

8. The saw according to claim 6 wherein with the lever in the stowed position, the main body is movable around the first axis relative to the housing.

9. The saw according to claim 6 wherein the housing has an annular surface that fully surrounds the main body.

10. The saw according to claim 1 wherein the first assembly extends from the mounting plate to the knob.

11. The saw according to claim 10 wherein the first assembly extends through a part of the housing.

12. A saw comprising:

a power unit with a drive component, a housing for the power unit and comprising a frame;

a bar on the housing for guiding movement of an operatively positioned cutting chain driven by the drive component in an endless path, the bar movable guidingly in opposite directions in a predetermined path relative to the housing to thereby vary tension upon an operatively positioned cutting chain;

a bar fixing assembly comprising a knob that is turnable around a first axis relative to the housing in: a) a first direction to a tightened state wherein the bar is fixed relative to the housing; and b) a second direction with the knob in the tightened state to a loosened state wherein the bar can be moved relative to the housing in the predetermined path, the knob moving in a turning range as the knob changes between the tightened and loosened states; and a first assembly with a first component that resiliently bears against a part of the knob comprising a first surface to thereby at least one of: a) inhibit turning of the knob around the first axis; b) provide a sensory indication to a user grasping and turning the knob that the knob is moving around the first axis; and c) reduce play in the knob, the first component biased in a direction generally parallel to the first axis against the first surface relative to which the first component moves as the knob is turned around the first axis, the first assembly permitting the knob to turn in opposite directions around the first axis through the turning range with the first component of the first assembly continuing to resiliently bear against the part of the knob, wherein the saw further comprises a mounting plate fixed to the housing, wherein the first component is attached to the mounting plate, wherein the first component traces an annular path around the first axis on the first surface as the knob is turned around the first axis and the first surface over the annular path is contoured so that the first component is caused by the first surface to shift repetitively oppositely substantially parallel to the first axis as the knob is turned in the same direction around the first axis wherein the first surface has a plurality of depressions spaced around the first axis and the first component moves into and out of the depressions as the knob is turned around the first axis.

13. The saw according to claim 12 wherein the first component has a convex surface that moves into and out of the depressions and the depressions have a shape that is complementary to the convex surface of the first component.

14. The saw according to claim 13 wherein the first component has a spherical shape and the depressions are bounded by surfaces defining a segment of a sphere.

15. The saw according to claim 12 wherein the plurality of depressions are spaced at regular intervals fully around the first axis and the first surface is defined on the knob.

16. The saw according to claim 15 wherein the first component is biased by a coil spring acting between the first component and the mounting plate to against the first surface.

17. The saw according to claim 16 wherein the saw further comprises a guard plate on one side of the bar and the mounting plate is located between the knob and the guard plate and the first assembly extends from the mounting plate to the knob.

18. The saw according to claim 17 wherein the first assembly extends through a part of the housing.

19. The saw according to claim 12 wherein the first component and first surface interact to generate an audible repetitive clicking sound as the knob is turned around the first axis.

20. The saw according to claim 12 wherein the first component and first surface interact to produce a repetitive force upon the knob that can be tactilely sensed by a user grasping and turning the knob around the first axis.

21. The saw according to claim 12 wherein the first component and first surface interact to generate forces that resist turning of the knob around the first axis as the first component moves repetitively and serially into and out of the depressions.

22. The saw according to claim 12 wherein the depressions are at closely spaced regular intervals around the first axis so that there is a thin step between adjacent depressions around the first axis.

23. A saw comprising:

a power unit with a drive component, a housing for the power unit and comprising a frame;

a bar on the housing for guiding movement of an operatively positioned cutting chain driven by the drive component in an endless path, the bar movable guidingly in opposite directions in a predetermined path relative to the housing to thereby vary tension upon an operatively positioned cutting chain;

a bar fixing assembly comprising a knob that is turnable around a first axis relative to the housing in: a) a first direction to a tightened state wherein the bar is fixed relative to the housing; and b) a second direction with the knob in the tightened state to a loosened state wherein the bar can be moved relative to the housing in the predetermined path, the knob moving in a turning range as the knob changes between the tightened and loosened states; and a first assembly with a first component that resiliently bears against a part of the knob comprising a first surface to thereby at least one of: a) inhibit turning of the knob around the first axis; b) provide a sensory indication to a user grasping and turning the knob that the knob is moving around the first axis; and c) reduce play in the knob, the first component biased in a direction generally parallel to the first axis against the first surface relative to which the first component moves as the knob is turned around the first axis, the first assembly permitting the knob to turn in opposite directions around the first axis through the turning range with the first component of the first assembly continuing to resiliently bear against the part of the knob, wherein the first component traces an annular path around the first axis on the first surface as the knob is turned around the first axis and the first surface over the annular path is contoured so that the first component is caused by the first surface to shift oppositely substantially parallel to the first axis as the knob is turned in the same direction around the first axis, wherein the first surface has a plurality of depressions spaced around the first axis and the first component moves into and out of the depressions as the knob is turned around the first axis, wherein the first component is biased by a spring to against the first surface, wherein the saw further comprises a mounting plate fixed to the housing and the first mounting plate component is attached to the mounting plate.

24. The saw according to claim 23 wherein the depressions are at closely spaced regular intervals around the first axis so that there is a thin step between adjacent depressions around the first axis.

25. The saw according to claim 23 wherein the spring is a coil spring.

26. The saw according to claim 24 wherein the first surface is defined on the knob.

27. A saw comprising:

a power unit with a drive component, a housing for the power unit and comprising a frame;

a bar on the housing for guiding movement of an operatively positioned cutting chain driven by the drive component in an endless path, the bar movable guidingly in opposite directions in a predetermined path relative to the housing to thereby vary tension upon an operatively positioned cutting chain;

a bar fixing assembly comprising a knob that is turnable around a first axis relative to the housing in: a) a first direction to a tightened state wherein the bar is fixed relative to the housing; and b) a second direction with the knob in the tightened state to a loosened state wherein the bar can be moved relative to the housing in the predetermined path, the knob moving in a turning range as the knob changes between the tightened and loosened states; and a first assembly with a first component that resiliently bears against a part of the knob comprising a first surface, the first component and first surface configured so that the first component moves alternatively in opposite directions in a linear path as the knob is turning in the same direction about the first axis, to thereby produce a force upon the knob that is repetitively applied as the knob is turning to thereby give a sensory indication to a user grasping and turning the knob that the knob is moving around the first axis, the first component biased in a direction generally parallel to the first axis against the first surface relative to which the first component moves as the knob is turned around the first axis, the first assembly permitting the knob to turn in opposite directions around the first axis through the turning range with the first component of the first assembly continuing to resiliently bear against the part of the knob, wherein the saw further comprises a mounting plate with a flat wall fixed to reside on one side of a part of the housing and the knob resides on the other side of the housing part, wherein the first assembly is biased away from the flat wall on the mounting plate toward the knob and extends through the housing part.

28. The saw according to claim 27 wherein the first component traces an annular path around the first axis on the first surface as the knob is turned around the first axis and the first surface over the annular path is contoured so that the first component is caused by the first surface to shift oppositely substantially parallel to the first axis as the knob is turned around the first axis.

29. A saw comprising:

a power unit with a drive component, a housing for the power unit and comprising a frame;

a bar on the housing for guiding movement of an operatively positioned cutting chain driven by the drive component in an endless path, the bar movable guidingly in opposite directions in a predetermined path relative to the housing to thereby vary tension upon an operatively positioned cutting chain;

a bar fixing assembly comprising a knob that is turnable around a first axis relative to the housing in: a) a first direction to a tightened state wherein the bar is fixed relative to the housing; and b) a second direction with the knob in the tightened state to a loosened state wherein the bar can be moved relative to the housing in the predetermined path, the knob moving in a turning range as the knob changes between the tightened and loosened states; and a first assembly with a first component that resiliently bears against a part of the knob comprising a first surface to thereby at least one of: a) inhibit turning of the knob around the first axis; b) provide a sensory indication to a user grasping and turning the knob that the knob is moving around the first axis; and c) reduce play in the knob, the first component biased in a direction generally parallel to the first axis against the first surface relative to which the first component moves as the knob is turned in the same direction around the first axis, the first assembly permitting the knob to turn in opposite directions around the first axis through the turning range with the first component of the first assembly continuing to resiliently bear against the part of the knob, wherein the saw further comprises a mounting plate that is fixed to a part of the housing and resides on one side of the part of the housing and the knob resides on the other side of the housing part, wherein the first assembly extends from the mounting plate to the knob and through the housing part, wherein the first component traces an annular path around the first axis on the first surface as the knob is turned around the first axis and the first surface over the annular path is contoured so that the first component is caused by the first surface to shift oppositely substantially parallel to the first axis as the knob is turned around the first axis, wherein the first surface has a plurality of depressions spaced around the first axis and the first component moves into and out of the depressions as the knob is turned around the first axis.

30. The saw according to claim 29 wherein the depressions are at closely spaced regular intervals around the first axis so that there is a thin step between adjacent depressions around the first axis.

* * * * *